US005299909A

United States Patent [19]

Wulf

[11] Patent Number: 5,299,909

[45] Date of Patent: Apr. 5, 1994

[54] RADIAL TURBINE NOZZLE VANE

[75] Inventor: James B. Wulf, Williamsville, N.Y.

[73] Assignee: Praxair Technology, Inc., Danbury, Conn.

[21] Appl. No.: 37,135

[22] Filed: Mar. 25, 1993

[51] Int. Cl.[5] ..... F01D 1/02; F01D 9/00

[52] U.S. Cl. ..... 415/186; 415/191; 415/208.3

[58] Field of Search ..... 415/186, 191, 208.2, 415/208.3, 211.1; 416/223 B; 29/889.2, 889.22

[56] References Cited

U.S. PATENT DOCUMENTS 4,099,891 7/1978 Campbell ..... 415/208.3
4,821,506 4/1989 Rodgers .
4,880,351 11/1989 Inoue et al. .
5,046,919 9/1991 Wulf .

FOREIGN PATENT DOCUMENTS 148903 11/1980 Japan ..... 415/191

OTHER PUBLICATIONS

"The Design of an Advanced Turbine For Brayton Rotating Unit Application" by A. M. Kirschner et al, Jul. 1971, NASA Lewis Research Center Report, CR-72888, pp. 24-25, 58, 87-89.

"The Determination of Deviation Angles at Exit from the Nozzles of an Inward Flow Radial Turbine" by F. Fairbanks, The American Society of Mechanical Engineers, Paper 80-GT-147, Mar. 10-13, 1980.

"R & D For Improved Efficiency Small Steam Turbines", Feb. 28, 1983, Final Technical Report, Phases I and II, Department of Energy DOE/ET/15426-T25, pp. 69, 70, 76-78, 162, 163, 175-177.

"An Investigation of the Flow Characteristics and of Losses in Radial Nozzle Cascades" by S. G. R. Hashemi et al, Transactions of the ASME, vol. 106, Apr. 1984, pp. 502-510.

"Special Characteristics of Fluid Flow In Axial-Flow Turbines With View To Preliminary Design" by G. Gyarmathy, Institut fur Energietechnik, Swiss Federal Institute of Technology, Zurich, Switzerland, Jul. 1986, pp. 5-45, 5-46, 5-62, 5-71.

"LDV Measurements and Investigation of Flow Field Through Radial Turbine Guide Vanes" by H. Eroglu et al. Transactions of the ASME, vol. 113, Dec. 1991, pp. 660-667.

*Primary Examiner*—Edward K. Look
*Assistant Examiner*—James A. Larson
*Attorney, Agent, or Firm*—Peter Kent; Chung K. Pak

[57] ABSTRACT

A radial inflow turbine having a radial nozzle assembly comprising a plurality of vanes, wherein downstream of the throat, the vane suction surfaces, relative to a radius of the circle on which the vane trailing edges lie, have a specified range of angles, or decreasing radii of curvature.

13 Claims, 2 Drawing Sheets

RADIAL TURBINE NOZZLE VANE

BACKGROUND

After World War II radial inflow turbines began to gain increasingly wide use in a wide range of applications due to their ease of manufacture, low cost, and high efficiency. Examples of these applications are gas turbines in aircraft auxiliary power units, turboexpanders for turbocharging in automotive vehicles, and turboexpanders in cryogenic air separation plants and gas liquefiers. In cryogenic plants, the turboexpanders usually operate continuously, and process large volumes of fluid. Energy input into a cryogenic plant is a principal cost, so that even small increases in efficiency in a cryogenic plant's turboexpanders are economically very beneficial.

The major losses in radial turbines are divisible into nozzle passage loss, rotor incidence loss, rotor passage loss, rotor discharge loss, and wheel disk friction loss. Radial turbine component losses can be measured by placing static pressure taps in the turbine gas path between the three major components: the inlet nozzle, the impeller and the exit diffuser. Analysis of field test data has shown that nozzle losses comprise a large part of the total turbine loss. Thus the aerodynamic configuration of the vanes comprising a radial inflow turbine nozzle present an opportunity for improvement.

Kirschner, Robertson, and Carter describe an approach to the definition of radial nozzle vanes in their July, 1971 NASA Lewis Research Center report CR-7288 entitled "The Design of an Advanced Turbine for Brayton Rotating Unit Application." In this work a vane camber line was generated from a prescribed distribution of loading on the vane. The thickness distribution of a 6-percent-thick NACA-63 airfoil was superimposed on the camber line. Surface velocities on this vane geometry were calculated, and minor adjustments in geometry were made until acceptable distributions were obtained.

Report No. 1390-5 dated Feb. 28, 1983, prepared by Northern Research and Engineering Corporation for the Department of Energy, designated DO-E/ET/15426)T25 and entitled "R & D For Improved Efficiency Small Steam Turbines" describes another approach to the design of radial nozzle vanes. From process requirements, inlet flow conditions of temperature, pressure and flow angle to the radial nozzle, and downstream flow conditions of exit flow angle and velocity were selected. An aerodynamically ideal surface velocity distribution was selected, and the axial vane geometry to produce the selected velocity distribution was calculated by a computer program entitled BLADE. The axial vane coordinates were then mathematically transformed into radial coordinates.

This invention provides another method of designing and fabricating radial nozzle vanes and radial nozzles with novel features. This invention also provides a radial inflow turbine having a novel radial nozzle assembly and having improved efficiency over prior known radial inflow tubines.

SUMMARY

This invention is directed to a radial inflow turbine having an impeller mounted for rotation about an axis. The impeller is encircled by a radial nozzle assembly comprising a plurality of vanes arranged with their trailing edges in a uniform circumferential spacing around a circle, and forming a minimum width or throat between adjacent vanes. Each vane for approximately one throat width downstream of the throat has a suction surface which relative to a radius of the circle, has an angle of about 2° to about 7° less than the angle whose cosine is equal to the throat width divided by the spacing. From the throat downstream to the trailing edge, the suction surface has an angle of not greater than about 1.5° greater than the angle whose cosine is equal to the throat width divided by the spacing.

The vane suction surface may be also be characterized as a smooth curve having radii of curvature which decrease by a factor of from about 4 to about 12 from the throat to the trailing edge. Preferably the radii of curvature decrease by a factor of from about 1.5 to about 4 over about the first 20% of the distance downstream from the throat to the trailing edge, and then by factor of less than about 1.5 over the remaining distance to the trailing edge.

DRAWINGS

DESCRIPTION

Smooth as used herein shall mean capable of being represented by a function with a continuous first derivative. Such a function may be a spline curve or a Bezier polynomial.

Continuous as used herein shall mean having the property that the absolute value of the numerical difference between the value at a given point and the value at any point in a neighborhood can be made as close to zero as desired by choosing the neighborhood small enough.

Surface angle as used herein shall mean the angle between a tangent to a vane surface at a given point and the radius through the point which is a radius of the circle on which the vane trailing edges lie. The center of this circle is also the center of rotation of the turbine impeller. The angle is measured counterclockwise from the radius.

Radius of curvature of a curve at a fixed point on the curve as used herein shall mean the radius of the circle through the fixed point and another variable point on the curve where the variable point approaches the fixed point as a limit. The radius of curvature is also the reciprocal of curvature.

Curvature as used herein shall mean the rate of change of the angle through which the tangent to a curve turns in moving along the curve and which for a circle is equal to the reciprocal of the radius.

Suction surface as used herein shall mean the surface on that side of an airfoil from leading edge to trailing edge over which a flowing fluid exerts pressures which are predominantly negative compared to the pressure in the fluid upstream of the airfoil.

Figure 1:
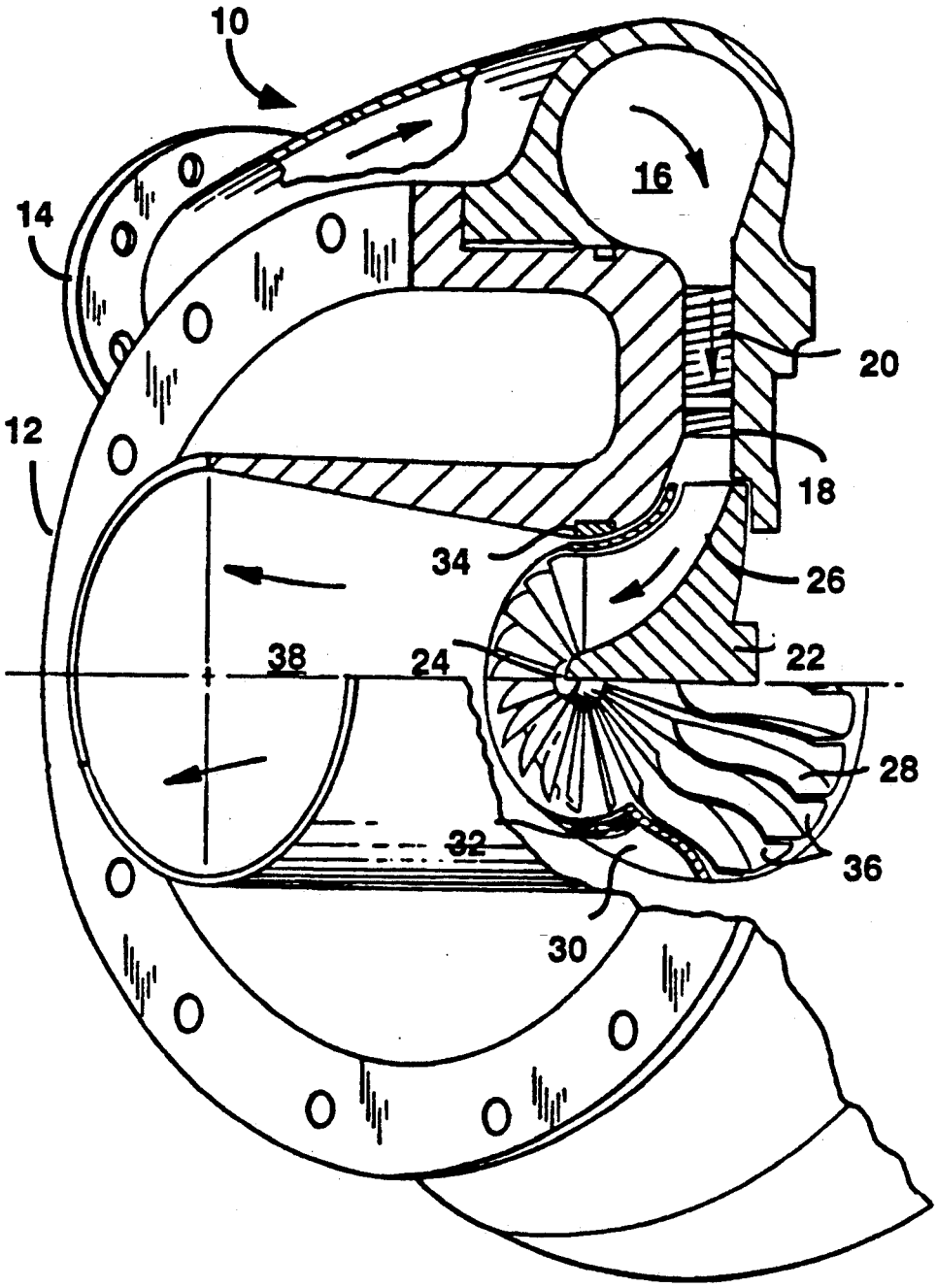
FIG. 1 is a three-dimensional illustration, partly in section, of a radial turbine capable of embodying the present invention.

The present invention is directed to a radial turbine 10 depicted in FIG. 1 as comprising a stationary housing 12 having a fluid inlet 14 and containing a fluid distribution channel 16 encircling a radial nozzle assembly 18 having a plurality of vanes 20. The vanes 20 encircle and discharge to an impeller 22 mounted for rotation about an axis comprising a shaft 24 supported by the housing 12. The impeller 22 comprises a hub 26 from which emanate a plurality of radially extending blades 28. The extremities of the blades 28 end at a shroud 30. The shroud may be stationary thereby forming an open impeller (not shown). Alternately, as shown in FIG. 1 the shroud may rotate with the impeller forming a closed impeller. With closed impellers an eye seal may be used. Extending radially outward from the rotating shroud of the closed impeller 22, are a plurality of circumferentially continuous fins 32 which together with an opposing stationary cylindrical surface 34 form a labyrinth seal to impede fluid from passing outside the impeller. The impeller hub 26, the blades 28, and the shroud 30 form fluid channels 36 which have a radial inlet from the distribution channel 16 and an axial discharge into an exhaust conduit 38. The shaft 24 connects to a loading means (not shown) such as a gas compressor or an electrical machine. Fluid enters the turbine inlet 14, is distributed by the channel 16 into the radial nozzle vanes 18, enters the impeller 22, propels the impeller blades 28, and discharges into the exhaust 38. The fluid performs work upon the impeller thereby being reduced in pressure and temperature.

Figure 2:
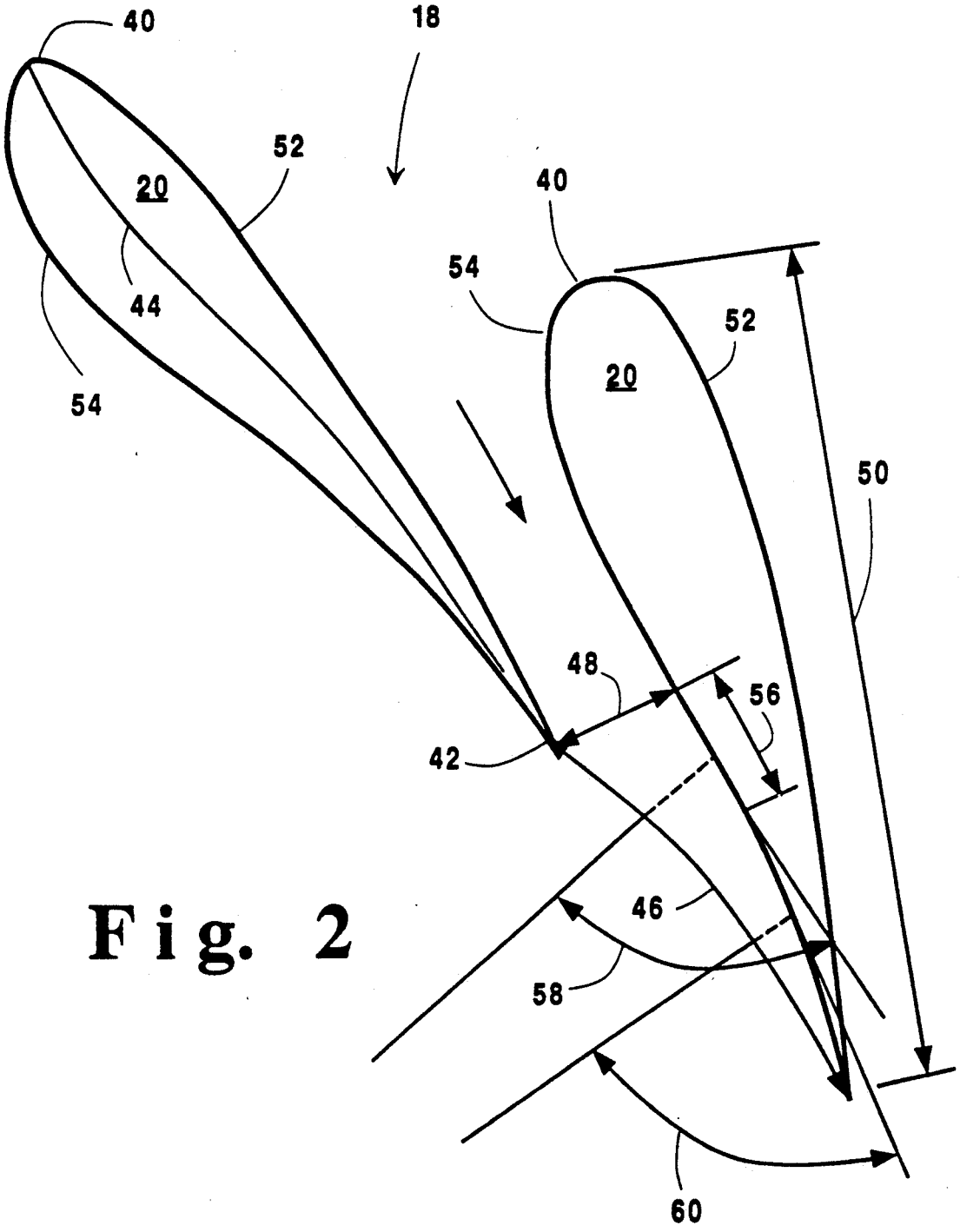
FIG. 2 is a section normal to the rotational axis of the rotor of FIG. 1, which section is through the radial nozzle assembly on the line and in the direction indicated by the arrows labeled 2—2 in FIG. 1, and shows two vanes of the nozzle assembly in cross section.

The radial nozzle 18 as depicted in FIG. 2 comprises a plurality of identical vanes 20, each extending curvilinearly inward from a leading edge 40 to a trailing edge 42. The vane mean line 44 can be either concave, convex, rectilinear or a combination of these. Typically a curved mean line is used. The vane trailing edges 42 lie on a circle with uniform circumferential spacing 46 between the trailing edges of adjacent vanes. The vanes are arranged to provide a minimum width for fluid flow, that is, a throat 48, between adjacent vanes. Each vane has a chord 50, a pressure surface 52, and a suction surface 54.

In the design of the vanes incorporated in the nozzles used for the experimental evaluation herein described, a family of known, low-loss, axial turbine stator vane shapes was selected, namely that described in NASA TN-3802. The mean line of the selected shapes was substantially concave with respect to the radially outward direction. The one-dimensional mean line and the thickness distribution of the selected shapes was conformally transformed from axial to radial coordinates.

The resulting radial vane was scaled to the desired size. Then with a selected throat velocity, typically sonic, the required throat area and width was calculated from compressible flow relations. The overall vane angle setting was selected to provide a suitable incidence flow angle at the impeller inlet. Flow velocities were calculated on the suction and pressure surfaces of the vanes using a inviscid two-dimensional system of equations. The leading edge radius was adjusted to provide a moderate velocity increase over the leading edge. In some instances, the blade chord was shortened upstream of the throat to approach the optimum chord-to-trailing-edge spacing ratio, typically from about 1.3 to about 1.5, empirically determined by Zwiefel and presented by G. Gyarmathy in "Special Characteristics of Fluid Flow In Axial-Flow Turbines With View To Preliminary Design", July 1986, Institut Fur Energietechnik, Swiss Federal Institute of Technology, Zurich, Switzerland.

A key constraint was that the calculated fluid velocities on the suction and pressure surfaces increased smoothly from the vane cascade inlet to the outlet, particularly with no diffusion or decelerations on the suction surface, and most particularly on the suction surface downstream of the throat. The suction surface downstream of the throat is a critical region in that large losses can occur in this region, typically from flow separation. The absence of local decelerations in the calculated suction and pressure surface velocities indicates the preclusion of separation and its attendant losses.

The radial vane geometries obtained from transformations of high efficiency axial vanes and the favorable surface velocity distributions calculated for these transformed geometries indicate that high efficiency of operation results when some turning of the vane suction surface occurs downstream of the throat. In particular, high efficiency is indicated when the suction surface, in planes normal to the axis of rotation of the impeller, is a smooth curve having the following characteristics. For approximately one throat width downstream 56 of the throat 48, the suction surface 54 has an angle 58 from about 2° to about 7° less than the angle whose cosine is equal to the throat width 48 divided by the circumferential spacing 46 of the trailing edges. The preferred range is from about 4° to about 6°, and most preferred from about 5° to about 6° less than the angle whose cosine is equal to the throat width divided by th spacing. Downstream of the throat to the trailing edge, the suction surface 54 has an angle 60 not greater than about 1.5° greater than the angle whose cosine is equal to the throat width 48 divided by the spacing 46.

Alternatively, the suction surface 54 downstream of the nozzle throat 48 can be characterized by the local radius of curvature. Favorable velocity distributions occur and high efficiency is indicated when the vane suction surface is a smooth curve in which the radius of curvature decreases by a factor of from about 4 to about 12 from the throat to the trailing edge of the vane. Preferably the radius of curvature decreases by a factor of from about 5 to about 6. Desirably the radius of curvature decreases rapidly just downstream of the throat and then less rapidly over the remainder of the distance to the trailing edge. Preferably the radius of curvature decreases by a factor of 1.5 to about 4 over the first 20% of the distance to the trailing edge, and then by a factor of from about 1.5 over the remaining distance to the trailing edge. Approaching the trailing edge, the radius of curvature may be increased to provide a trailing edge with sufficient thickness and radius so as to facilitate manufacture.

An example is a vane cascade in which the vane suction surface at the throat has a surface angle of 64.4° and the arcuate distance from the throat to the trailing edge is 4.47 centimeters. The arcuate distance from the throat to the trailing edge is characterized at ten equally spaced points, starting at the throat and ending at the trailing edge, by radii of curvature in centimeters as follows: 112.7, 39.7, 24.1, 17.1, 13.6, 11.3, 9.62, 8.74, 19.5, 19.5.

Three different novel configurations of radial nozzles, denoted as Configuration Numbers 2 to 4, were fabricated for comparative testing by substitution for an existing nozzle, denoted as Configuration No. 1, installed in a cryogenic radial expansion turbine in operation in a nitrogen liquification plant. Performance measurements were made of each nozzle configuration installed and operating in the same environment.

Novel configurations 2 to 4 were fabricated pursuant to the procedure described above, and employed the same basic vane overall shape, a shape obtained from transformation of axial vanes which had demonstrated high efficiency. Configuration 3 differed from Configuration 2 in that the vane chord was reduced upstream of the throat to provide a chord-to-spacing ratio close to the optimum recommended by Zwiefel. Configuration 4 was similar to Configuration 2 except that the cascade had 20 vanes rather than 14. The suction surface angles and radii of curvature downstream of the throat in each configuration met the criteria described above.

Configuration Number 1 was designed and fabricated pursuant to prior practice. In prior practice, the required throat width to accommodate the flow was obtained from one-dimensional compressible flow calculations. The vanes were then set at an angle providing the desired flow incidence at the impeller inlet. The suction and pressure surfaces at the throat were made straight and parallel for some distance downstream less than half of the throat width. Between the throat and the trailing edge, a constant radius of curvature was faired, typically on the order of two to three times the trailing edge spacing. The chord was selected to approximate the optimum chord-to-trailing edge spacing ratio empirically determined by Zwiefel, typically from about 1.3 to about 1.5. The leading edge radius was then made typically in the order of 25% of the chord length. The remainder of the vane surfaces were faired in using arcs and straight lines while accommodating the variable-angle, vane positioning mechanism employed.

All four configurations embodied characteristics favorable to efficient performance including the following. The exit Mach number ranged from about 0.5 to about 1.0; the exit angle of the vanes at the trailing edge with respect to the tangential direction was in the range of from about 10° to about 30°; the nozzle cascade exit radius ranged from about 1.04 to about 1.15 times the impeller radius; and the number of vanes ranged from 9 to 30. The ratio of the vane chord to the circumferential spacing of the vane trailing edges was within the range of from about 1.2 to about 3.2 and within a preferred range of from about 1.4 to about 2.4. Test results are given in the following table of comparative results.

TABLE OF COMPARATIVE TEST RESULTS FOR NOZZLE CONFIGURATIONS

| Configuration Number | Number of Vanes | Chord to Spacing Ratio | Peak Isentropic Efficiency % | Difference in Peak Efficiency %-units |
|---|---|---|---|---|
| 1 | 14 | 1.47 | 90.2 | 0.0 |
| 2 | 14 | 2.03 | 91.3 | 1.1 |
| 3 | 14 | 1.51 | 89.8 | −0.4 |
| 4 | 20 | 2.08 | 90.3 | 0.1 |

Configuration No. 2 provided the highest efficiency, which is attributed to the suction surface criteria specified above, a favorable chord-to-spacing ratio in the range of from about 1.8 to about 2.2, and a preferred number of vanes in the range of from about 10 to 90 in combination with a trailing edge circumferential spacing in the range of from about 1.04 to about 1.15 times the impeller radius. Thus an embodiment of the invention is capable of yielding a radial inflow turbine with a peak efficiency at least 1.1 percentage-units greater than known prior art radial flow turbines. Configuration No. 3 had the poorest performance which was attributed to impairment of the flow and inefficiencies introduced by the crude reduction of the chord length upstream of the throat performed in order to meet the Zwiefel optimum chord-to-spacing ratio. Configuration No. 4 may have experienced performance degradation owing to the increased friction induced by the larger number of blades employed in that configuration.

While the gas flow path through the nozzle vanes has been treated in calculations as two-dimensional, this path need not be restricted to two dimensions. Contoured vanes having shapes on the vane hub surface, the vane shroud surface and vane intermediate surfaces which are different may be utilized. In such a nozzle, the lines lying on the suction and pressure surfaces of the vanes and extending from hub to shroud would not be parallel.

Although the invention has been described with respect to specific embodiments, it will be appreciated that it is intended to cover all modifications and equivalents within the scope of the appended claims.

What is claimed is:

1. A radial turbine having an impeller mounted for rotation about an axis and encircled by a radial nozzle comprising a plurality of nozzle vanes having trailing edges arranged with a circumferential spacing around a circle and a nozzle throat defined by a minimum width between adjacent vanes wherein at least one vane for approximately one throat width downstream of the throat has a suction surface, which relative to a radius of the circle, has an angle of about 2° to about 7° less than an angle whose cosine is equal to the throat width divided by the spacing; and downstream of the throat to the trailing edge has an angle of not greater than about 1.5° greater than the angle whose cosine is equal to the throat width divided by the spacing.

2. The radial turbine as in claim 1 wherein said vane suction surface relative to a radius through said circle has an angle for approximately one throat width downstream of said throat of about 5° to about 6° less than said angle whose cosine is equal to said throat width divided by said spacing.

3. The radial turbine as in claim 1 wherein the suction surface downstream of the throat is a smooth curve in planes normal to the axis of rotation.

4. The radial turbine as in claim 1 wherein said vanes have a chord and the ratio of said chord to said circumferential spacing is from about 1.2 to about 3.2.

5. The radial turbine as in claim 1 wherein said vanes have a chord and the ratio of said chord to said circumferential spacing is from about 1.4 to about 2.4.

6. A radial turbine having an impeller mounted for rotation about an axis and encircled by a radial nozzle comprising a plurality of nozzle vanes having trailing edges arranged to provide a nozzle throat between adjacent vanes wherein at least one vane, in a plane normal to the axis of rotation, has a suction surface which is a smooth curve having radii of curvature which decrease by a factor of from about 4 to about 12 from the throat to the trailing edge of the vane.

7. The radial turbine as in claim 6 wherein at least one vane, in a plane normal to the axis of rotation, has a suction surface which is a smooth curve having radii of curvature which decrease by a factor of from about 5 to about 6 from the throat to the trailing edge of the vane.

8. The radial turbine as in claim 6 wherein at least one vane has a suction surface, which in a plane normal to the axis of rotation, is a smooth curve having radii of curvature which decrease by a factor of from about 1.5 to about 4 over about the first 20% of the distance from the throat downstream to the trailing edge, and then by a factor of less than about 1.5 over the remaining distance to the trailing edge.

9. A method of fabricating a radial turbine comprising a rotor mounted for rotation about an axis and encircled by a radial nozzle having a plurality of vanes each having a trailing edge and a suction surface, said method comprising:

(a) arranging said vanes with their trailing edges on a circle at a circumferential spacing and a minimum width between adjacent vanes to form a throat; and (b) forming each vane suction surface for approximately one throat width downstream of said throat with an angle relative to a radius of said circle of about 2° to about 7° less than the angle whose cosine is equal to said throat width divided by said spacing; and downstream of the throat to the trailing edge with an angle not greater than approximately 1.5° greater than the angle whose cosine is equal to said throat width divided by said spacing.

10. The method as in claim 9 further comprising (c) forming each vane suction surface downstream of the throat with a smooth curve in planes normal to the axis of rotation.

11. A method of fabricating a radial turbine comprising a rotor mounted for rotation about an axis and encircled by a radial nozzle having a plurality of vanes each having a trailing edge and a suction surface, said method comprising:

(a) arranging said vanes with their trailing edges on a circle at a circumferential spacing and a minimum width between adjacent vanes to form a throat; and (b) forming at least one vane suction surface which, in a plane normal to the axis of rotation, is a smooth curve having radii of curvature which decrease by a factor of from about 4 to about 12 from the throat to the trailing edge of the vane.

12. The method as in claim 11 wherein said at least one vane suction surface, in a plane normal to the axis of rotation, is a smooth curve having radii of curvature which decrease by a factor of from about 5 to about 6 from the throat to the trailing edge of the vane.

13. The method as in claim 11 wherein at least one vane, in a plane normal to the axis of rotation, has a suction surface which is a smooth curve having radii of curvature which decrease by a factor of from about 1.5 to about 4 over about the first 20% of the distance from the throat downstream to the trailing edge, and then by a factor of less than about 1.5 over the remaining distance to the trailing edge.

* * * * *